US007364518B2

(12) United States Patent
Abel et al.

(10) Patent No.: US 7,364,518 B2
(45) **Date of Patent: *Apr. 29, 2008**

(54) WRIST TOY

(75) Inventors: Jeffrey T. Abel, Victor, MT (US); James Abel, Spokane, WA (US)

(73) Assignee: Ketch-It Company, Spokane, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/293,595

(22) Filed: Dec. 2, 2005

(65) Prior Publication Data

US 2006/0111205 A1 May 25, 2006

Related U.S. Application Data

(63) Continuation-in-part of application No. 10/772,156, filed on Feb. 3, 2004, now Pat. No. 6,971,963, which is a continuation-in-part of application No. 10/116,838, filed on Apr. 5, 2002, now Pat. No. 6,685,582, which is a continuation of application No. 08/699,152, filed on Aug. 16, 1996, now Pat. No. 6,368,241.

(51) Int. Cl.
*A63B 43/00* (2006.01)

(52) U.S. Cl. ..... 473/508; 473/576

(58) Field of Classification Search ..... 473/424, 473/506, 508, 576, 423, 425, 430
See application file for complete search history.

(56) References Cited

U.S. PATENT DOCUMENTS

| | | | | |
|---|---|---|---|---|
| 667,563 | A | | 2/1901 | Oakley |
| 729,473 | A | | 5/1903 | Wilson |
| 795,960 | A | | 8/1905 | Cook |
| 1,782,254 | A | | 11/1930 | Brcidenbach |
| 2,142,068 | A | | 12/1938 | Berger |
| 2,269,633 | A | | 1/1942 | Merle |
| 3,031,191 | A | | 4/1962 | Bonang |
| 3,531,115 | A | | 9/1970 | Alexander |
| 3,635,476 | A | | 1/1972 | Breslow et al. |
| 3,693,972 | A | * | 9/1972 | Minchin ..... 473/575 |
| 3,731,927 | A | | 5/1973 | Rocco, Jr. |
| 3,785,643 | A | | 1/1974 | Rich |
| 3,843,126 | A | | 10/1974 | Bandy |
| 3,940,133 | A | | 2/1976 | Civita |
| 4,042,241 | A | | 8/1977 | Collins |
| 4,121,822 | A | | 10/1978 | DiSabatino et al. |
| 4,121,829 | A | | 10/1978 | Petrusek |
| 4,147,353 | A | | 4/1979 | Moore |
| 4,272,076 | A | | 6/1981 | Song et al. |
| 4,321,888 | A | * | 3/1982 | Topliffe ..... 119/709 |
| 4,346,902 | A | | 8/1982 | Warehime |
| 4,601,474 | A | | 7/1986 | Lew et al. |

(Continued)

FOREIGN PATENT DOCUMENTS

GB 2263408 7/1993

*Primary Examiner*—John A. Ricci
(74) *Attorney, Agent, or Firm*—Law Office of SC Harris

(57) ABSTRACT

A toy with a springable cord and an object at the other end of the cord, which object can be a ball of many kinds, or a device covering a ball. The ball may include electronics therein that are actuated when the ball is hit against a surface.

6 Claims, 6 Drawing Sheets

U.S. PATENT DOCUMENTS

| | | | | |
|---|---|---|---|---|
| 4,687,209 | A | 8/1987 | Carey | |
| 4,753,442 | A | 6/1988 | Bland | |
| 4,836,554 | A | 6/1989 | Robbins | |
| 4,836,555 | A | 6/1989 | Wexler | |
| 5,083,797 | A | 1/1992 | Vartija et al. | |
| 5,094,462 | A | 3/1992 | Boyle et al. | |
| 5,181,726 | A | 1/1993 | Piaget | |
| 5,401,034 | A | 3/1995 | Mallinger | |
| 5,443,576 | A | 8/1995 | Hauter | |
| 5,544,894 | A | 8/1996 | Howard | |
| 5,586,760 | A | 12/1996 | Hauter | |
| 5,772,542 | A | 6/1998 | Gildea et al. | |
| 5,853,339 | A | 12/1998 | Sccrbo | |
| 6,109,490 | A | 8/2000 | Caluori | |
| 6,368,241 | B1 * | 4/2002 | Abel | 473/508 |
| 6,685,582 | B2 * | 2/2004 | Abel | 473/508 |
| 6,971,963 | B2 * | 12/2005 | Abel | 473/508 |

* cited by examiner

WRIST TOY

BACKGROUND

This is a continuation-in-part of Ser. No. 10/772,156, filed Feb. 3, 2004, now U.S. Pat. No. 6,971,963, which is a continuation-in-part of U.S. patent application Ser. No. 10/116,838, filed Apr. 5, 2002, now U.S. Pat. No. 6,685,582, which is a continuation of U.S. patent application Ser. No. 08/699,152, filed Aug. 16, 1996, now U.S. Pat. No. 6,368,241. The above-referenced patent applications are incorporated herein by reference.

SUMMARY

The apparatus of the present invention is a toy. In particular, an embodiment describes a toy employing an elastic cord is configured to minimize contact and abrasion of the elastic cord with the intended surface and employing means for preventing the elastic cord from knotting or twisting. Another aspect describes a connection to a larger in size and hollow ball. Other aspects describe other kinds of balls, and other devices at the end of the end of the elastic cord, other than a ball.

DETAILED DESCRIPTION

According to disclosed aspects, an object, e.g. a ball, or other object, can be thrown against walls or floors or simply to a distance until the length of the elastic cord causes the object. One aspect is directed to development of eye-hand coordination. That is, the toy may be preferably thrown and caught by the same hand.

One aspect describes minimizing interference caused by the cord when the ball is thrown and during the rebound travel of the ball. Because the ball of the present invention can and does strike wall and/or floors, it is also important to provide a construction which will minimize degrading wear of the elastic cord.

An embodiment describes the object being a ball, and the wrist toy comprises a wrist band, an elastic cord member and a ball. The elastic cord member is attached directly to the ball employing means for minimizing contact of the elastic cord with the floor or wall. The wrist band comprises a webbed band secured about the limb of the user. The wrist band is provided with means for receiving the elastic member and for avoiding or minimizing the twisting or knotting of the entire length of the elastic cord and ball.

In an embodiment, the means for minimizing contact of the elastic cord with the floor or wall is accomplished by passing the elastic member directly through only a portion of the ball, not necessarily through the center or along a central axis of the ball. A preferred structure of the means to avoid or minimize the twisting or knotting of the entire length of the elastic cord and ball employs a freely rotating swivel releasably connected to the wrist band. A novel feature of the present invention is the position of the freely rotating swivel located on the wrist of the user so as to be at the base of the hand of the user.

The rebounding of the ball is directed to the hand of the user while avoiding or minimizing the twisting or knotting of the entire length of the elastic member.

Another aspect describes an inflatable ball used in such a system, including an attachment mechanism to the inflatable ball.

Figure 1:
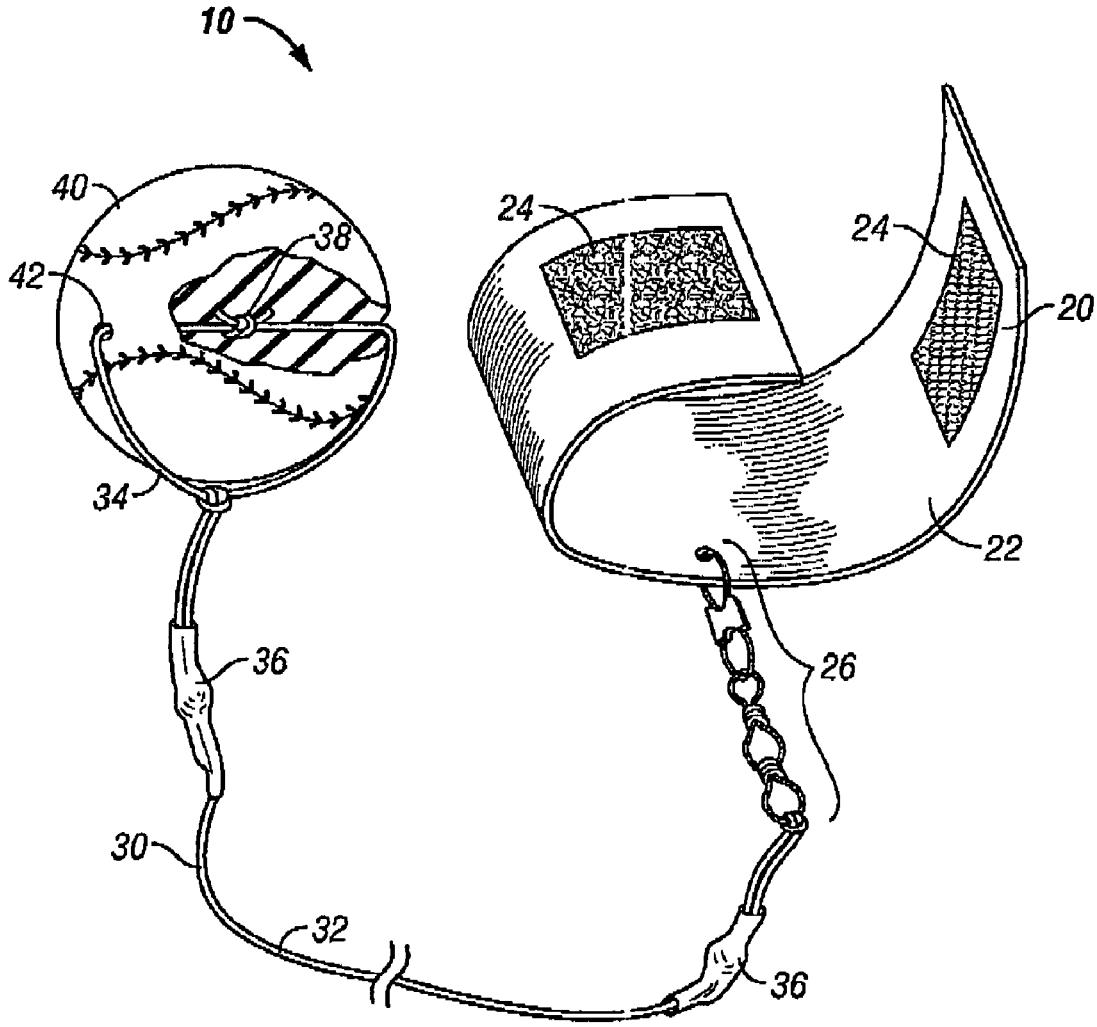
FIG. 1 is a perspective view of one embodiment of the retrievable toy of the present invention.

FIG. 1 shows a first embodiment 10 in which the object is a ball. Apparatus 10 comprises wrist band 20, elastic member 30 and ball 40.

Wrist band 20 comprises a length of nylon webbing 22 to encircle the limb of the user. Means 24 for fastening wrist band 20 may include any conventional fastening means. FIG. 1 illustrates the use of conventional hook and pile fastening means. Hook and pile is preferred because it is adjustable to different size wrists. Snaps, buttons or other adjustment or fastening means may provide equivalent function.

Wrist band 20 also comprises means for avoiding or minimizing the twisting or knotting of the entire length of the elastic cord and ball. The preferred embodiment of the means for avoiding or minimizing the twisting or knotting of the entire length of the elastic cord comprises a freely rotatable swivel 26. Swivel 26 is releasably attachable to webbing 22. In order to optimize the rebound of ball 40 to the hand of the user, swivel 26 is attached to an edge of webbing 22. This provides the user with the advantage of being able to wear wrist band 20 such that swivel 26 is positioned just at the base of the user's palm. Attaching swivel 26 at the edge of the webbing 22 also advantageously minimizes any interference of the rotating action of swivel 26 and, hence, of the entire length of elastic member 30.

Figure 2:
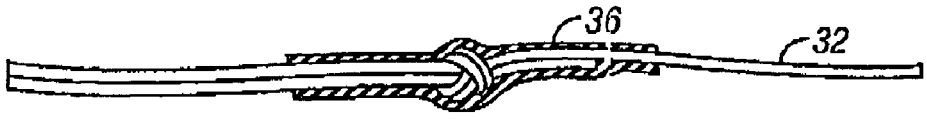
FIG. 2 is a detailed view of a transition length of an elastic band employed by the present invention.
Figure 3:
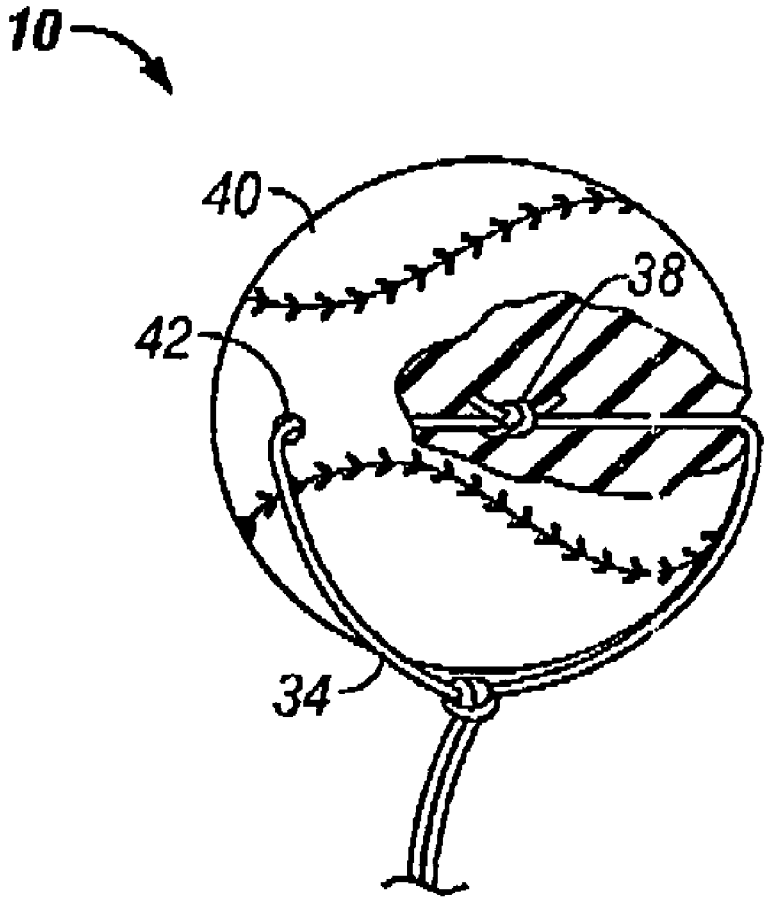
FIG. 3 shows a detailed connection to the ball.

Elastic member 30 comprises two members, elastic rebounding cord member 32 and means 34 for minimizing contact of the elastic cord with the floor or wall. Elastic cord 32 provides the retrieving, rebounding effect needed. Cord 32 is attached directly to swivel 26 at one end and to the means 34 for minimizing contact of the elastic cord with the floor or wall at the other end. To optimize the endurance of cord 32 and to prevent any scratching to the user, sleeve 36 may shroud the knots and ends of cord 32. FIG. 2 shows one embodiment of how sleeve 36 shrouds the knots and ends of cord 32.

The preferred embodiment of means 34 for minimizing contact of the elastic cord with the floor or wall comprises attachment member 34. Attachment member 34 may be made of the same material as cord 32. However, the preferred embodiment of attachment member 34 comprises a flat elastic construction so that it lies flatter against ball 40. Attachment member 34 is connected to ball 40 by passing a portion of attachment member 34 through a bore 42 in ball 40. It is preferred to tie a knot 38 in attachment member 34 and to draw knot 38 inside ball 40. Bore 42 may pass through an axis of ball 40. However, in the preferred embodiment, bore 42 passes through a portion of ball 40 not along an axis of ball 40 such that a larger continuous surface of ball 40 is free of the attachment member 34, thereby minimizing the contact of attachment member 34 with contact surfaces such as floors and/or wall. In this way, when thrown, a larger mass of the ball is the leading portion of ball 40 which ultimately contacts a floor or wall thereby minimizing contact of attachment member 34 or cord 32 with a floor or wall.

Ball 40 comprises any ball. Preferably ball 40 comprises a rubber or spongy ball which can be adapted with a bore 42 to receive member 34. For example, ball 40 can be made of a soft material which deforms upon impact to absorb impact energy but which material is sufficiently elastic such that the ball after impact and recoil transforms back to its preimpact shape. Preferably ball 40 is of a weight which when thrown is not significantly hindered by elastic member 30.

It will be appreciated that wrist band 20, elastic member 30 and ball 40 may be manufactured in any color or combination of colors as desired.

Figure 4:
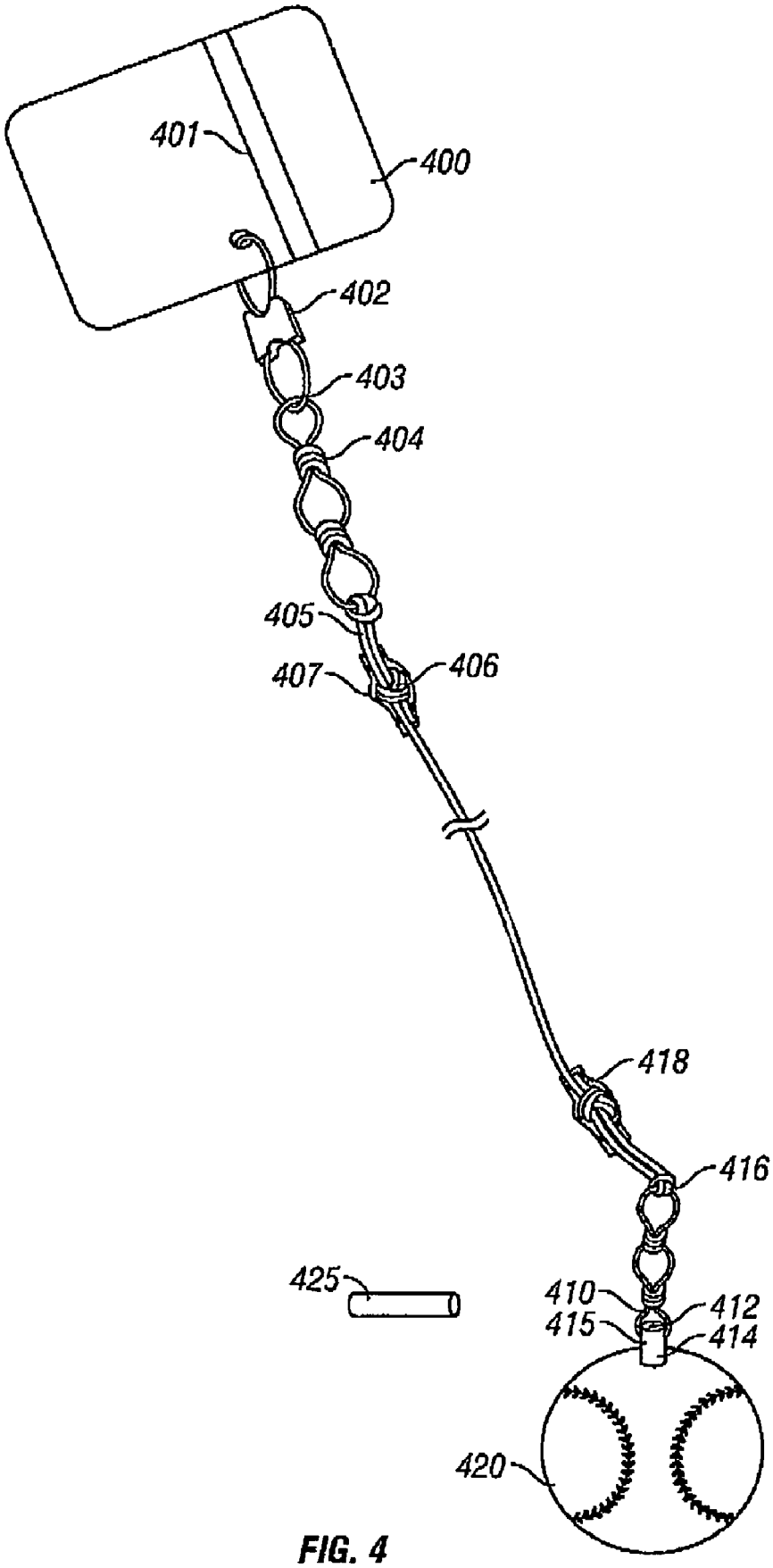
FIG. 4 shows a detail of another embodiment in which a larger in size, blowup ball, is used.

An alternative embodiment is shown in FIG. 4. This embodiment is similar to the previous embodiments, however uses an inflatable ball 420. The previous embodiment, which used a pre-formed ball, fit the pre-formed ball into a package which was intended to be placed on a shelf. Making the ball larger became problematic; simply because of packaging. By using an inflatable ball, any arbitrary sizable can be used without significantly increasing the package size.

A new connection to this inflatable ball, one which also serves as a stopper for the air, is also disclosed. The wrist strap 400, more generally a limb strap, includes a swivel connection 402 as in the first embodiment, connected to an elastic cord 405. The elastic cord 405 passes through the swiveling end 403 of the swivel, and is also knotted there at 404. The elastic cord is also knotted at 406, where the free end, that has passed through the swiveling portion 403, is knotted to the main portion of the cord 405. The knotted portion 406 is covered by a shrink-wrapped sleeve 407.

The elastic cord is also connected to a connection mechanism on the ball 420. The connection mechanism on the ball includes a ring portion 410 molded to a stopper portion 412. The bottom portion 414 of the stopper mates to an air intake opening, e.g., a hole 419 in the inflatable ball 420, and is beveled to form a variable diameter cylinder, with a smaller diameter on its bottom. The cylinder is placed into the hole 419 in the ball, and holds the air therein.

The ball may also be provided with an air inflation mechanism 425, e.g., a straw which fits into the hole 419. The ball can be inflated through the straw, and then the surfaces 415 of the beveled stopper portion are placed into the hole 419, and act as a stopper to hold the air therein.

Therefore, the stopper portion has two functions: the surfaces 415 hold the air in the ball, and in addition, the top portion of stopper portion includes a ring connecting mechanism 410 which provide a ring-shaped surface allowing connection to the elastic cord without presenting any sharp edges.

The elastic cord is routed through the connecting mechanism 410, and also knotted at 416. The cord passes back and is knotted again at 418. The portions of the cord which are knotted may be covered with shrinkable tubing which has been shrunk.

The shrinkable tubing has two functions: first, it can prevent wear on those portions of the cord. In addition, since the tubing is shrunk, it aids in structurally holding the different cord portions in place.

In operation, the user attaches the wrist band to their wrist or other limb, and uses the Velcro closure 412 to attach the band more tightly. Then, the user can kick the ball, and the force of the kick causes the ball to move, until the extended cord is elastically stressed enough to counteract the force of the ball. At that point, the ball springs back so that the user can kick it again.

Modifications of this system are also possible. For example, this system may operate properly without the swivel, having the elastic cord connected directly to the wrist portion. In addition, the ball need not be inflatable, and rather can be a solid material. While the above has described the ball attachment part also having surfaces used to hold the air within the ball, a separate plug can be used, and another attachment part can be formed on the surface of the ball. While the above has described the wrist portion being formed of Velcro, it is also should be apparent that the wrist portion could be formed of other materials such as elastic which can expand to allow placing over the user's hand, and then contract to hold on the user's wrist.

Figure 5A:
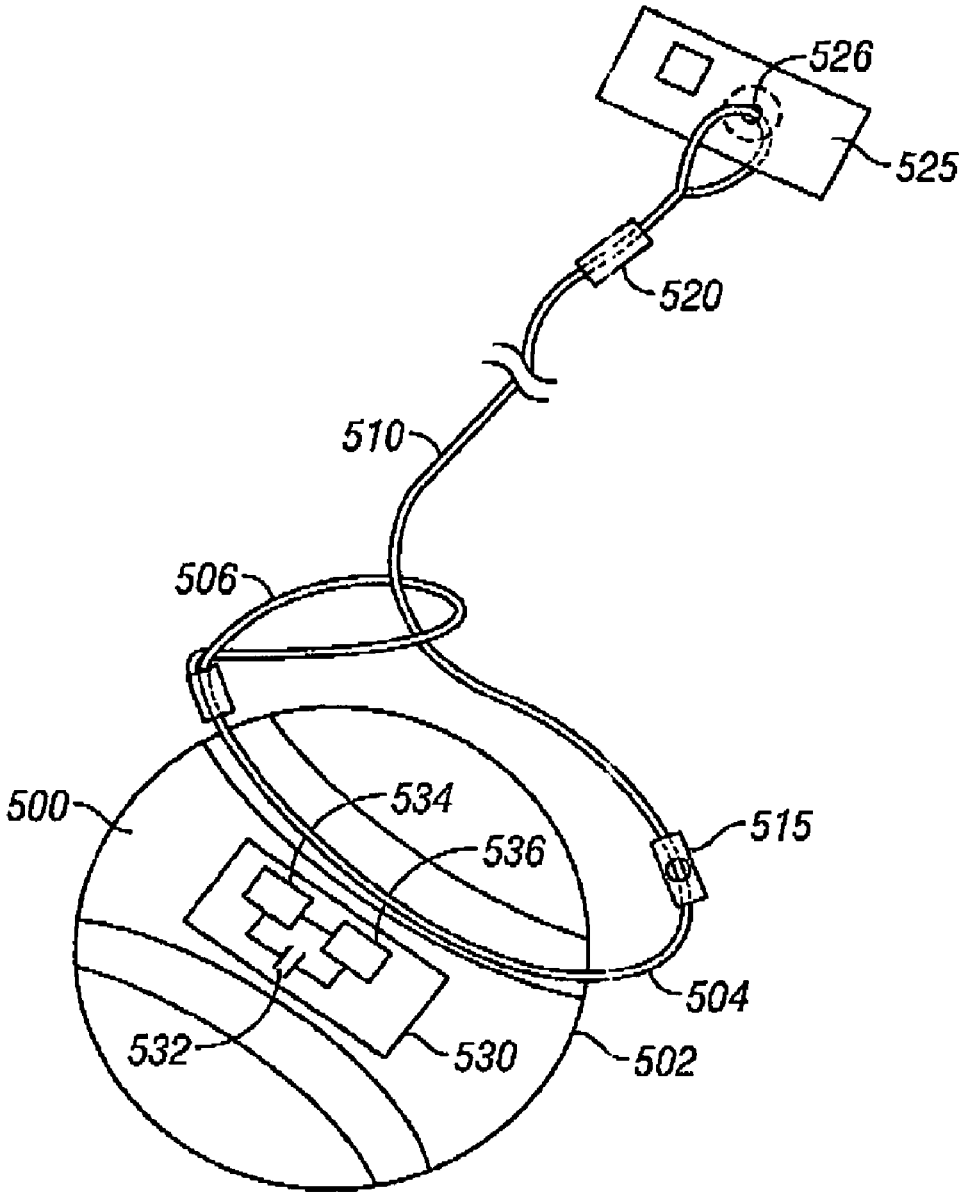
FIG. 5A shows another embodiment using a field goal.

FIG. 5 shows another embodiment in which the "object" which is at the end of the elastic cord, is actually a solid core ball that is not inflated with air. The ball can be a rigid plastic ball. A channel 502 through the ball 500 is located to enable the elastic cord connecting portion 504 to extend through the ball. One end of the connecting portion 504 ends in a loop 506. The loop is looped through the main portion of the elastic cord 510. As in previous embodiments, the cord 506 may be attached, by a knot covered by shrink sleeve, at an attachment portion 515, to a first end of the main portion of the elastic cord 510. The second end of the elastic cord 510 is also attached at an attachment portion 520, which again may be a knot covered with shrink sleeve. The wrist portion may be, as in other embodiments, a Velcro connected nylon portion, here with a hole therein. The hole can include a grommet lining the edges of the hole to reduce the possibility of tearing. A looped portion of the elastic extends through the hole 526 and is connected by a knot to the connection portion 520. There may be one or more swivels, as in the previous embodiments.

An important difference with the rigid ball is that the ball itself includes significant structural integrity on its own. A therefore, the location of the bore 502 can be very near to an edge of the ball, and need not be through to the center of the ball. An advantage of this configuration is that the ball can be held at a location very much off its center of gravity, thereby adding to the realism of the game. For example, the ball may have a 2 inch diameter, and the bore 502 may occupy a location which is, for example, approximately ¼ inch from the edge of the ball. More generally, the 2 inch ball has a diameter axis extending through its center, about 1 inch from any edge. It may be preferred that the bore extends from a location between ⅛ and ½" from the edge of the ball. It may also be preferred that the bore is in the outer 50% of the area of the ball, more preferably in the outer 25%.

Figure 5B:
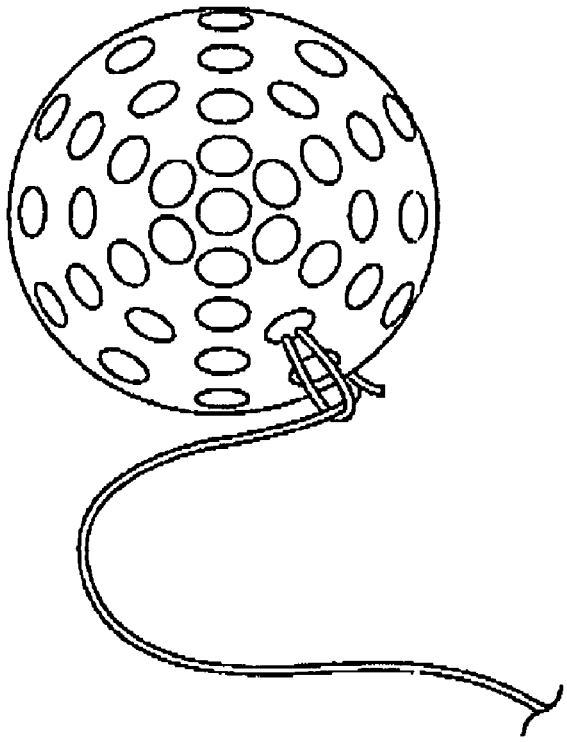
FIG. 5B shows an embodiment where the ball has multiple bores therein.

In order to facilitate the symmetry of the ball, other bores may also be located through the ball even though they are not used. These other bores may be located in areas to enhance the symmetry. For example, bores may be located in any symmetrical pattern around the ball. FIG. 5B also shows some additional bores being located in the ball; some that extend completely through the ball, others that extend only partway through the ball. This may enhance the symmetrical look of the product.

The ball may also include an electronics device shown as 530 therein which may include a battery, a motion detecting part 534, and an electronics module 536. The motion detecting part 534 is a conventional device which may detect motion. Device 534 may detect, for example, acceleration and then may be actuated each time the ball hits a surface or changes direction. Alternatively, device 534 may simply detect motion. The detection of the motion actuates electronics module 536. Electronics module 536 may be a part which produces light when actuated, produces sounds when actuated, such as sirens, simulated screens, a simulated clicks, or any other type of sound.

Figure 6:
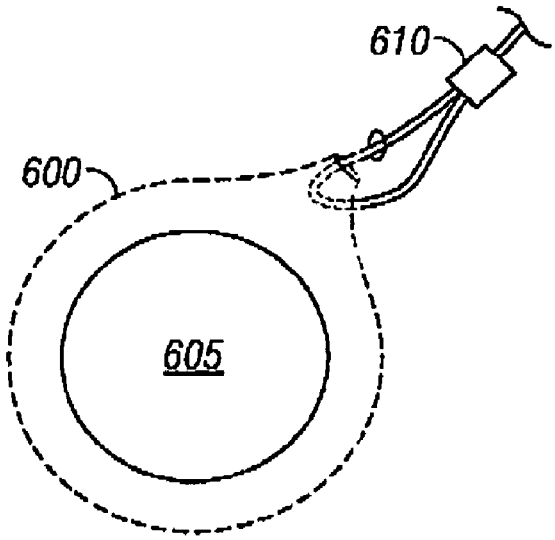
FIG. 6 shows an embodiment where a deformable ball is used, and a bag is used around the ball to hold the ball.
Figure 7:
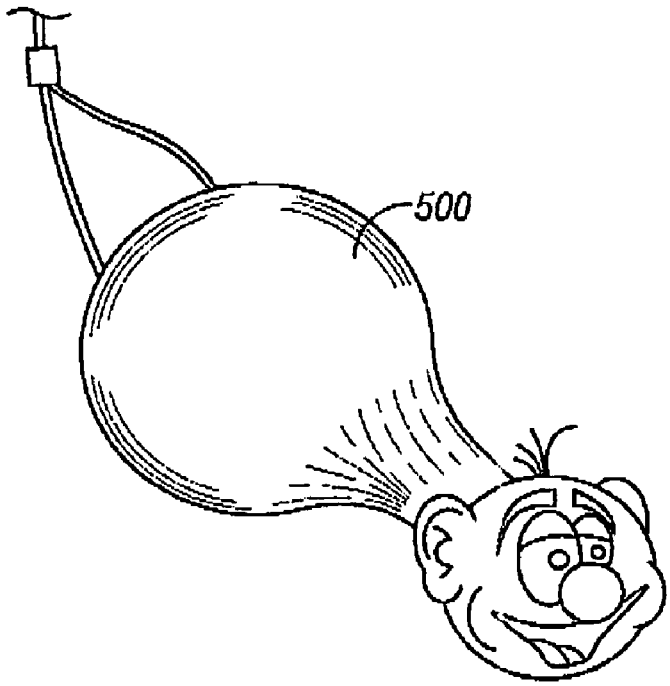
FIG. 7 shows an embodiment where a figurine is used around the ball.

FIG. 6 illustrates the use of a soft filled ball as the object. This soft ball is not necessarily round, but is made of the material that maintains a memory of its shape, and covered with an outer covering of a rubber or other elastomeric material. The ball deforms when squeezed, and maintains its deformed shape. Therefore, when used as part of a game, each time the ball touches an object, it will change its shape somewhat. This ball may be connected to the elastic as in the other embodiments, or alternatively may be covered with a bag as shown as 600. The bag covers the ball 605 so that no holes in the ball need to be made. The bag may be made of nylon or other mesh material which allows a user to see through the bag, and see the ball inside. A connection to the bag may be by a rivet, or may include a swivel. Again, the connection may include the cord extending through a hole in the bag, and tied back on itself at a connection area 610.

The ball or object 605 within the bag can be any object, including any of the objects described in any of these embodiments, or any other object. This embodiment describes the use of a memory material ball, but it should be understood that other devices can be used.

Another aspect includes a figurine with a ball inside. A ball, such as the ball 500, is located inside an animal or other shell. The ball 500 is connected as in previous embodiments. The ball 500 may include, as in the previous embodiments, a sound producing device, or any other kind of electronic device. The device may be incorporated within different stuffed animals, including an insect, a teddy bear, a nondescript monster, or any kind of covering.

The electronic device may make growling sounds in this embodiment, where the sounds may be the kinds of sounds that might be otherwise made by the covering or may say words, such as "ouch", and "that hurts" or may make simulated sounds of the ball touching the wall or some other surface. The electronic device may produce a sequence of sounds or a random sound selected from a library of possible sounds.

Figure 8:
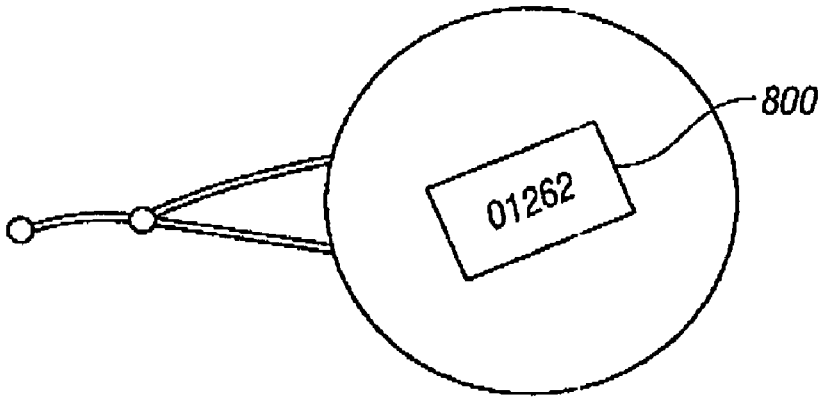
FIG. 8 shows an embodiment where a counter is used in the ball.

Another aspect includes putting a counter into a object, as shown in FIG. 8. In the FIG. 8 device, the ball has a counter display 800 showing through a surface of the ball, displaying the number of times the ball has been bounced. The counter may be for example, an accelerometer which detects movement of the ball.

Although only a few embodiments have been disclosed in detail above, other embodiments are possible and the inventor (s) intend these to be encompassed within this specification. The specification describes specific examples to accomplish a more general goal that may be accomplished in other way. This disclosure is intended to be exemplary, and the claims are intended to cover any modification or alternative which might be predictable to a person having ordinary skill in the art.

Also, the inventor(s) intend that only those claims which use the words "means for" are intended to be interpreted under 35 USC 112, sixth paragraph. Moreover, no limitations from the specification are intended to be read into any claims, unless those limitations are expressly included in the claims.

What is claimed is:

1. An apparatus, comprising:

a limb attachment part, having inner surfaces adapted to surround a limb of a user;

a spherical ball, having a connection portion attached thereto across an arc thereof, defined between outer surfaces of the spherical ball;

an elastic cord, coupled to said limb attachment part at one end, and having a second end, distant from said one end;

said second end extending through said connection portion in said spherical ball, and having a portion on an outside surface of said spherical ball and where said portion presses against said outer surface of said ball, wherein said second end is formed of a flat elastic portion.

2. An apparatus as in claim 1, further comprising a protective sleeve formed of a shrinkable material, covering said knot and at least one free end of said elastic cord.

3. An apparatus as in claim 1, further comprising a swivel, connected between said limb attachment part and said elastic cord.

4. An apparatus as in claim 1, wherein said elastic cord is directly connected to said limb attachment part.

5. An apparatus as in claim 1, wherein said limb attachment part is formed of hook and pile type attachable material.

6. An apparatus, comprising:

a limb attachment part, having inner surfaces adapted to surround a limb of a user;

a spherical ball, having a connection portion attached thereto across an arc thereof, defined between outer surfaces of the spherical ball;

an elastic cord, coupled to said limb attachment part at one end, and having a second end, distant from said one end;

said second end extending through said connection portion in said spherical ball, and having a portion on an outside surface of said spherical ball and where said portion presses against said outer surface of said ball, wherein said second end includes a knot on an inside surface of the ball.

* * * * *